US006510675B1

(12) United States Patent
Strässler

(10) Patent No.: US 6,510,675 B1
(45) Date of Patent: Jan. 28, 2003

(54) FASTENING OF A CAP ON A CONTAINER

(75) Inventor: Felix Strässler, Marly (CH)

(73) Assignee: Maschinenfabrik Polytype S.A. (CH)

( * ) Notice: Subject to any disclaimer, the term of this patent is extended or adjusted under 35 U.S.C. 154(b) by 0 days.

(21) Appl. No.: 09/451,582

(22) Filed: Nov. 30, 1999

(30) Foreign Application Priority Data

Nov. 26, 1998 (DE) ..... 198 54 709

(51) Int. Cl.[7] ..... B67B 3/20
(52) U.S. Cl. ..... 53/490; 53/317; 53/331.5
(58) Field of Search ..... 53/490, 317, 331.5

(56) References Cited

U.S. PATENT DOCUMENTS

| | | | | |
|---|---|---|---|---|
| 3,440,798 A | | 4/1969 | Rackley | |
| 5,467,527 A | * | 11/1995 | Zanini et al. | 53/133.2 |
| 5,687,552 A | * | 11/1997 | Barca | 53/490 |
| 5,816,029 A | * | 10/1998 | Sweeny | 53/490 |
| 6,158,196 A | * | 12/2000 | Trebbi et al. | 53/331.5 |

FOREIGN PATENT DOCUMENTS

| | | |
|---|---|---|
| CH | 624 627 A5 | 8/1981 |
| CH | 637 600 A5 | 8/1983 |
| DE | 2 164 570 | 6/1973 |
| DE | 41 09 241 A1 | 11/1991 |
| GB | 2 322 851 A | 9/1998 |

* cited by examiner

*Primary Examiner*—Eugene Kim
*Assistant Examiner*—John Paradiso
(74) *Attorney, Agent, or Firm*—McGlew and Tuttle, P.C.

(57) ABSTRACT

During the fastening of a cap (2) on a container (1), the container (1) and the cap (2) are positioned in a starting position in relation to one another and subsequently connected to one another in a positive-locking and preferably also non-positive manner. The cap (2) is held during the positioning by a clamping grip. The positioned cap (2) is taken over by a non-clamping holding mechanism (5), and the clamping grip of the cap (2) is released before the positive-locking and preferably also non-positive connection.

19 Claims, 3 Drawing Sheets

FASTENING OF A CAP ON A CONTAINER

FIELD OF THE INVENTION

The present invention pertains to a process and a device for fastening a cap on a container, wherein the container and the cap are provided with engaging means cooperating for the purpose of fastening. The present invention pertains, in particular, to the fastening of a turn cap.

BACKGROUND OF THE INVENTION

Prior-art devices for fastening a screw cap on a container, e.g., a tube, are designed as shown in FIG. 1. A tube 1 is positioned by a mandrel acting as a positioning means 3 in a defined starting position and is set into a rotary movement around its own longitudinal axis in this starting position. A turn cap 2 for the tube 1 is held by holding pliers 4 in a starting position positioned accurately in relation to the tube. The screw threads of the tube 1 and of the turn cap 2, which are to be screwed together, are located exactly flush with one another in this starting position. The holding pliers 4 are linearly displaced from the starting position toward the tube 1 along the axis of alignment A of the two screw threads by means of a corresponding drive means. In the course of the fastening, the holding pliers 4 first move toward the tube 1 with the turn cap 2, clampingly holding it. After the tube 1 and the cap 2 or its screw thread have engaged one another, a further displacement of the turn cap 2 is brought about by the screwing that is now beginning. The starting position of the tube 1 and the turn cap 2 is shown in the top part, and the end position after the fastening is shown in the bottom part of FIG 1. In this end position, the tube 1 and the turn cap 2 are connected in a positive-locking manner and preferably also in a non-positive manner with a defined tightening torque.

When this predetermined tightening torque has been reached, the turn cap 2 is rotated further by a small amount in relation to its holding pliers 4, as a result of which the surface of the turn cap 2, which is usually coated, may be damaged.

EP 0 205 803 A1 describes a device in which a rotating drive of the screw head and a holding means directly holding the turn cap are connected to one another in a screw head forming the holding means via a flexible torsion coupling to prevent excessively strong tightening torques. The torsion coupling absorbs the rotation energy of the mass, which continues to rotate and is formed by the container and the turn cap, and guarantees as a result a so-called soft screw drop during the screwing on of the turn cap. The risk of damage to the surface of the turn cap is reduced, but not eliminated altogether. A requirement that the turn cap must be in an accurate rotary position in relation to the tube may also cause problems.

SUMMARY AND OBJECTS OF THE INVENTION

The primary object of the present invention is to fasten a cap on a container such that the cap will not be damaged during the fastening.

According to the invention, a device for fastening a cap on a container is provided, wherein the container and the cap are provided with engaging mechanism cooperating for the purpose of fastening the two with respect to each other. The device includes a positioning mechanism for the container. A holding and positioning mechanism is provided with a clamping holding mechanism, which clampingly holds the cap and positions same in a starting position in relation to the container. The positioning mechanism and the holding and positioning mechanism engage the container and the cap with one another and connect them to one another in a positive-locking manner and preferably also in a non-positive manner by a forced relative movement. The holding and positioning mechanism comprises a non-clamping holding mechanism, which is fastened to the positioned cap. The non-clamping holding mechanism is movable in relation to the clamping holding mechanism.

According to another aspect of the invention, a process is provided for fastening a cap to a container. The cap and container are provided with an engaging mechanism cooperating for the purpose of fastening, in which. The process includes positioning the container and the cap in a starting position in relation to one another and they are subsequently connected to one another in a positive-locking and preferably also non-positive manner. The cap is held by a clamping grip during the positioning. The positioned cap is taken over by a non-clamping holding mechanism and the clamping grip of the cap is released before the positive-locking and preferably also non-positive connection is made.

The present invention is based on a container, e.g., a tube, can, bottle or the like, and a cap therefor, which are provided with cooperating engaging mechanism for the purpose of fastening or attaching the cap to the container. The cap is preferably a turn cap and the engaging mechanism are screw threads or an engaging mechanism of a bayonet catch. However, the present invention may also be applied, in principle, to other caps and engaging mechanism in which the cap is, e.g., pushed simply onto the container and the positive-locking and preferably non-positive connection is established by simple wedging or locking; even though the container and the cap would possibly be connected to one another in a positive-locking manner only in the latter case, there would be a combined positive locking and nonpositive locking up to the locking proper.

For the purpose of fastening, the container and the cap are first positioned in a starting position in relation to one another. A relative movement between the container and the cap will subsequently take place from the starting position, the cap being connected and fastened to the container in a positive-locking and non-positive manner at the end of this relative movement. For positioning, the cap is held by a suitable holding mechanism by means of a clamping grip. The holding mechanism used to position the cap is hereinafter called correspondingly a clamping holding mechanism or clamping holding means.

The positioned cap, i.e., the cap being held in a defined starting position in relation to the container by the clamping holding mechanism, is taken over according to the present invention by a non-clamping holding mechanism or non-clamping holding means and the clamping grip of the clamping holding mechanism is released after the take-over. Since the take-over takes place in a defined position of the cap, the taking-over holding mechanism, which preferably holds the cap until the completion of the fastening, may be formed by a non-clamping holding mechanism. The risk of damage to a coated surface of the cap at the end of the fastening operation due to the tightening torque to be applied is effectively reduced as a result; damage is avoided in practice, because a holding grip of the cap takes place in a non-clamping manner at this critical moment.

A device that is especially suitable for carrying out the above-described process has a positioning mechanism or positioning means for the container as well as a holding and positioning mechanism or means for the cap, which comprises the clamping holding mechanism, which clampingly holds the cap in the defined starting position in relation to the container.

According to the present invention, the holding and positioning mechanism or means comprises, in addition to the clamping holding mechanism, the non-clamping holding mechanism, which is fastened to the positioned cap, i.e., the cap still being held by the clamping holding mechanism. The non-clamping holding mechanism is movable according to the present invention together with the cap in relation to the clamping holding mechanism. The clamping grip, by which the clamping holding mechanism has held the cap in the starting position until secure take-over by the non-clamping holding mechanism, is released.

The non-clamping holding mechanism preferably has a contact piece fastened to the cap in a manner secured against rotation and displacement and a connection piece, which is in turn fastened to a platform, which is preferably arranged movably in relation to a frame of the device. The platform may be formed, in principle, by the frame itself In the case of stationary arrangement of the non-clamping holding mechanism, the container would be able to be moved out of the starting position toward the cap.

To fasten the cap on the container with a defined tightening torque or a defined tightening force, as a result of which an initially purely positive-locking engagement between the container and the cap becomes a positive-locking and non-positive connection, the contact piece of the non-clamping holding mechanism is connected to the connection piece in an articulated manner, preferably by mechanism of a pivot bearing, and a coupling, preferably a friction coupling, which is pressed against the contact piece with a frictional force corresponding to the tightening torque or the tightening force, prevents a movement of the articulated connection and consequently a relative movement between the contact piece and the connection piece. As soon as the desired tightening torque or the desired tightening force is reached, the frictional coupling releases the rigid connection between the contact piece and the connection piece or the platform, as a result of which a further relative movement between the container and the cap is prevented. Simultaneously with the elimination of the rigid connection between the contact piece and the connection piece or the platform, the fastening of the contact piece on the cap is preferably eliminated as well.

The non-clamping holding mechanism may be connected to the cap in a purely positive-locking manner, but this requires a corresponding preparation of the cap. It would also be possible to use, quite generally, a holding magnet, e.g., in the case of metallic caps.

In a preferred embodiment, the non-clamping holding mechanism is a suction-type holding mechanism with a suction tube, which is directly attached to the cap and is fastened by mechanism of suction force.

Not only damage-free fastening is achieved if the non-clamping holding mechanism is designed as a suction-type holding mechanism. Since the suction-type holding mechanism can be arranged in an especially simple manner on a rear face of the cap, its use is also possible independently from the shape and the surface finish of the outer jacket surface of the cap. Since the clamping holding mechanism also needs to hold the cap in the starting position, adaptation to different jacket shapes of the cap is also possible in a simple manner.

Furthermore, if a frictional coupling is arranged, it is achieved with a particularly simple design that the cap can be fastened to the container accurately in terms of the angle of rotation and with a defined tightening torque or a defined tightening force.

However, accurate fastening in terms of the angle of rotation with a simultaneously accurate setting of a desired tightening torque or a desired tightening force is also facilitated, in principle, by the use of a non-clamping holding mechanism. If the non-clamping holding mechanism is designed, in particular, preferably as a suction-type holding mechanism, this can be achieved by the fastening of such a suction-type holding mechanism, which fastening is detachable quasi free from distortion when the desired tightening torque or the desired tightening force is reached.

The container is a tube, can, bottle, glass jar or the like, preferably from the field of the food industry, hygiene, cosmetics or medicine. The containers for whose closure the present invention is preferably used are, e.g., tubes for pastes, such as toothpaste, ointments and foods in the form of pastes, bottles for beverages, glass jars for jams or even small perfumery bottles.

Preferred embodiments of the present invention will be described below on the basis of FIGS. 2 and 3.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1A:
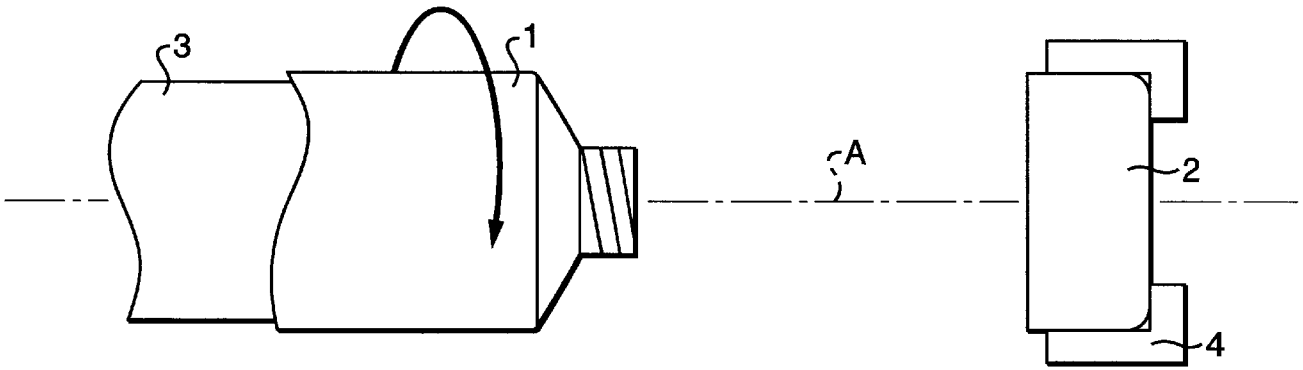
FIG. 1A is a view showing a device for fastening a cap on a container according to the state of the art.
Figure 1B:
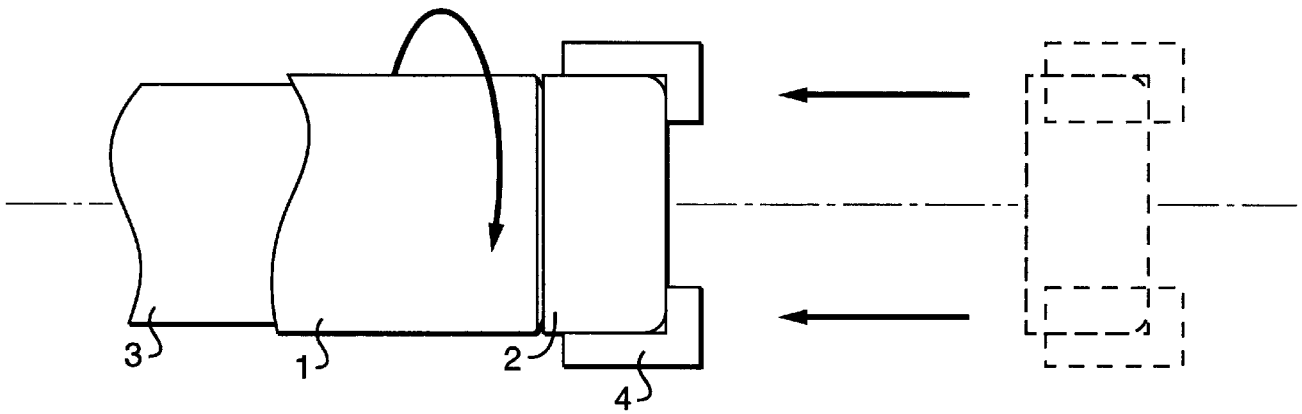
FIG. 1B is another view showing the device of FIG. 1A for fastening a cap on a container according to the state of the art.

FIG. 1 shows a device known from the state of the art and described already in the introduction.

Figure 2A:
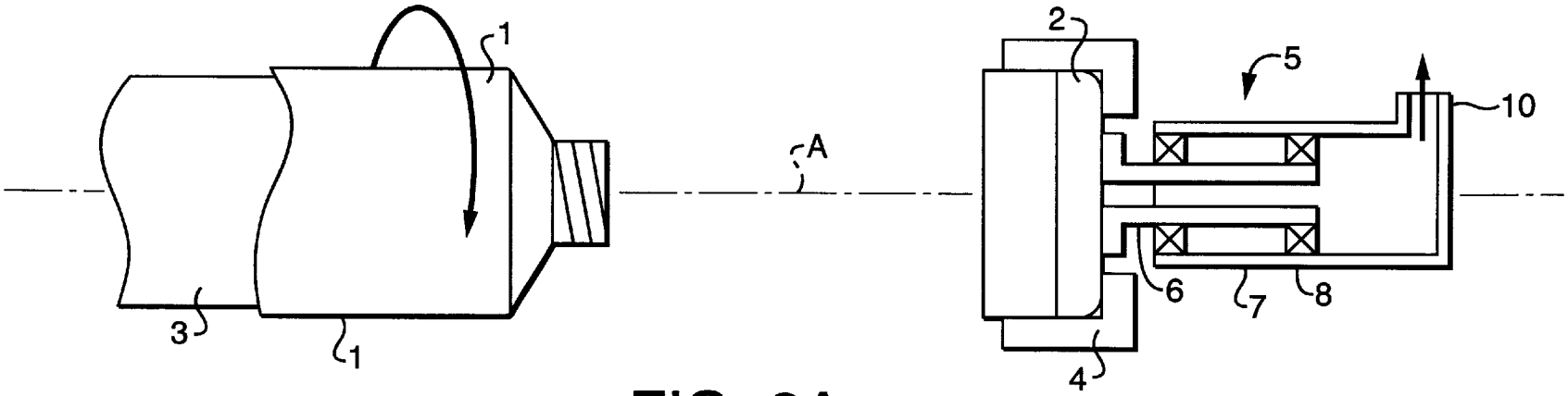
FIG. 2A is a view of a device according to the present invention with a suction-type holding mechanism showing some of the connection steps.
Figure 2B:
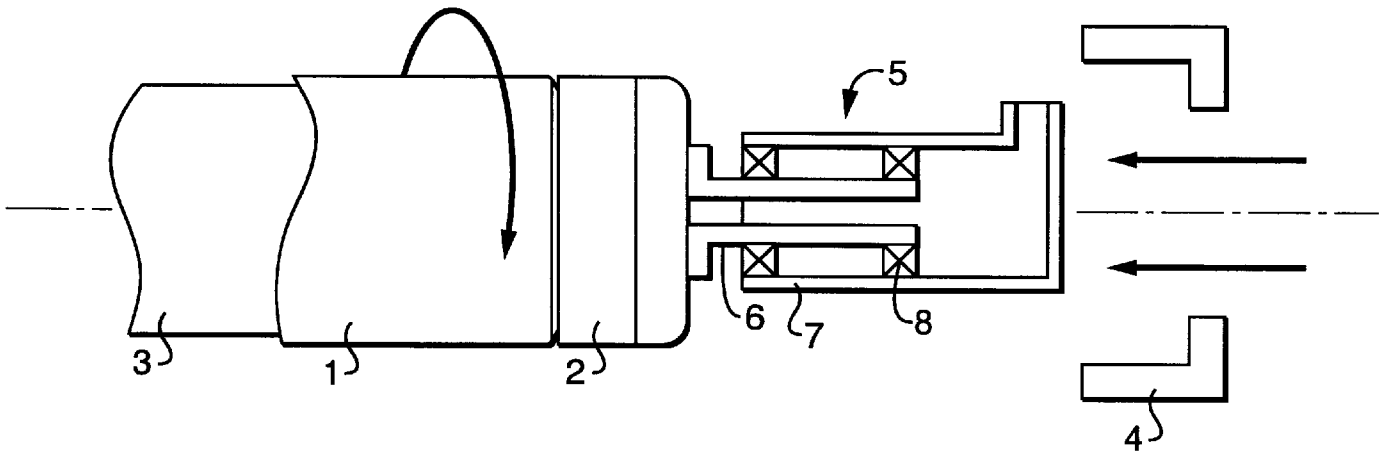
FIG. 2B is a view of a device according to the present invention with a suction-type holding mechanism shown showing some of the connection steps.

FIG. 2 shows a container 1 and a cap 2 to be fastened to the container 1 in a defined starting position. The container 1 is formed by a tube and the cap 2 by a screw cap. In the defined starting position, the cap 2 assumes a position relative to the container 1 in which the engaging mechanism or means of the container 1 and of the cap 2, which are designed as screw threads each, are arranged flush with one another, so that the cap 2 is also displaced toward the container 1 along the alignment A.

The cap 2 is held in the starting position by a clamping holding means 4. The holding is brought about by a clamping grip acting on the jacket surface of the cap 2. The clamping holding means 4 will hereinafter be called the cap pliers.

While the cap 2 is still being held by the cap pliers 4 in position to the container 1, i.e., in the starting position, a non-clamping holding means 5 is attached to a rear, flat face of the cap 2 and fastened, secured against rotation and displacement. The fastening is based on suction. The non-clamping holding means 5 attaches itself firmly to the face of the cap 2 by suction. It will hereinafter be called correspondingly a suction-type holding means 5.

Since the suction-type holding means 5 is fastened to the cap 2 while the cap 2 is still being held in position by the cap pliers 4, the position of the cap 2 relative to the suction-type holding means 5 is also defined, and the handing over of the cap 2 from the cap pliers 4 to the suction-type holding means 5 can take place.

The suction-type holding means 5 has a suction tube 6, which, used as a direct contact piece to the cap 2, is brought into contact with the face of the cap 2, such that a continuous channel through the suction tube 6 opens on the face of the cap 2 in the attached position. The continuous channel is sealed toward the cap 2 around the mouth opening. At its rear end facing away from the cap 2, the suction tube 6 is surrounded by a connection piece 7. The connection piece 7 has a sleeve body, which concentrically surrounds a rear sleeve area of the suction tube 6. The suction tube 6 is mounted on the sleeve body of the connection piece 7 by means of a radial bearing 8. The axis of rotation of the radial bearing 8 coincides with the axis of alignment A in the starting position. The connection between the suction tube 6 and the connection piece 7 is air-tight.

Figure 3:
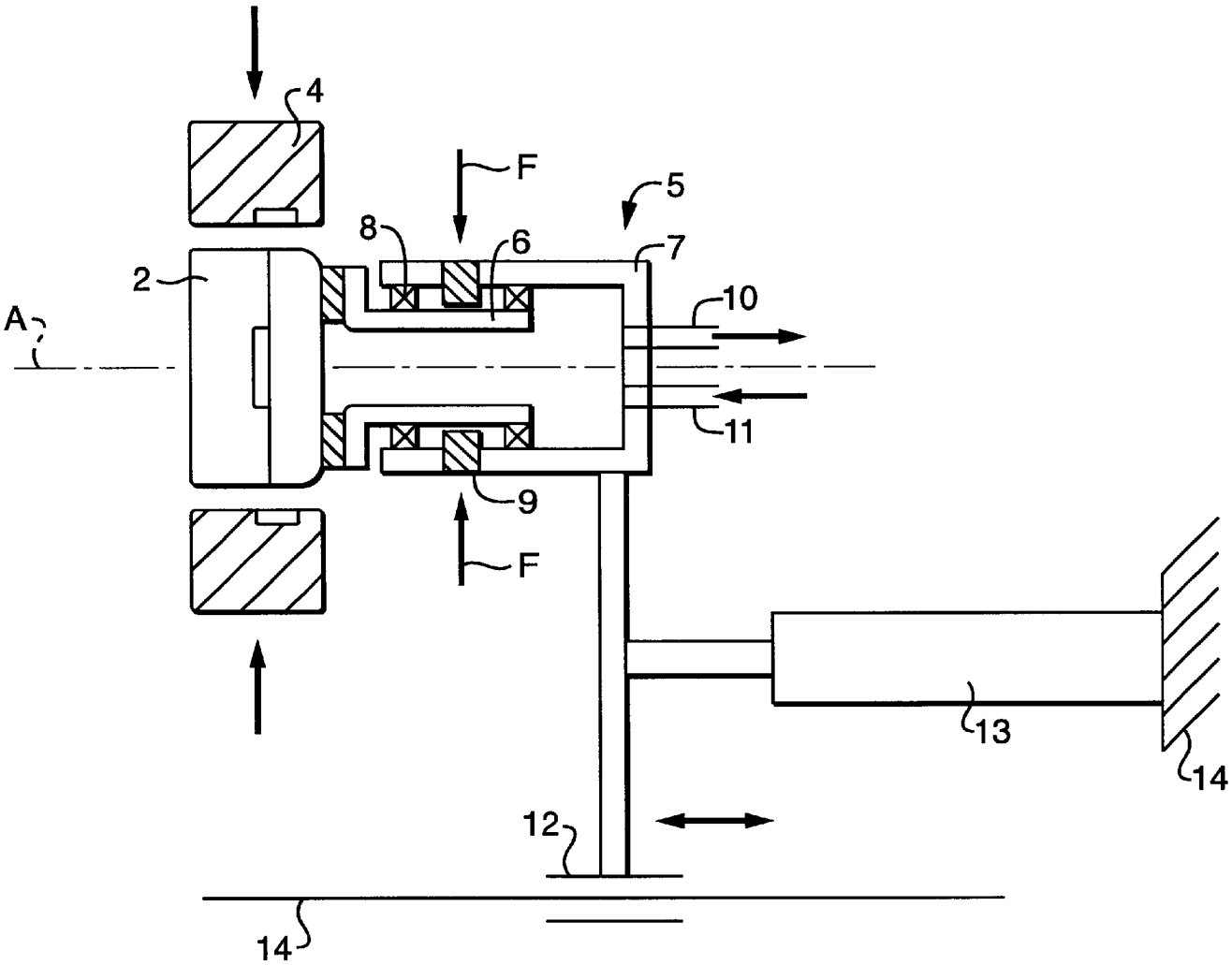
FIG. 3 is the device according to FIGS. 2A and 2B, but additionally with a friction coupling.

As can be best recognized from FIG. 3, a cavity enclosed by the suction tube 6 and the connection piece 7 has an outlet 10 to a vacuum source and an air inlet 11, which is closed by a valve, preferably to a compressed air source. Thus, a vacuum, which can be broken abruptly by readmitting pressure into the cavity to eliminate the suction connection, can be generated in the cavity to establish the suction fastening of the suction-type holding means 5 on the cap 2; provisions may also be made to generate overpressure in the cavity to eliminate the connection in a particularly reliable manner.

After the suction-type holding mechanism or means 5 has been securely fastened to the cap 2, the clamping grip of the cap pliers 4 is released. To do so, the clamping jaws of the clamping pliers 4 are moved away from the cap 2 in the radial direction. After the cap 2 has been freed from the clamping pliers 4, the suction-type holding means 5 is displaced linearly toward the container 1 along the axis of alignment A by a drive device or means 13. The drive means 13 is formed by a hydraulic or pneumatic cylinder, which is articulated with one end to a frame 14 of the device and with its other end to a platform 12, which is mounted linearly displaceably on the frame 14. It would also be possible, in principle, to arrange the suction-type holding means 5 stationarily on the frame 14 and to displace the container 1, instead. It is likewise possible, in principle, to rotatingly drive the suction-type holding means 5 and to arrange the container 1 secured against rotation to generate the relative movement needed for the screwing. However, the rotatingly driven arrangement of the container 1 in conjunction with the displaceable arrangement of the suction-type holding means 5, secured against rotation, is preferred.

A positioning device or means 3, which positions the container 1 in the predetermined alignment shown and rotates it in this position around its longitudinal axis, is provided in the exemplary embodiment. The positioning device or means 3 is formed by a rotatingly driven mandrel, to which the hollow cylindrical body of the container 1 is attached. The device according to FIG. 2 uses this driving means 3 which is known per se (see FIG. 1). The relative movement between the container 1 and the cap 2 for the purpose of fastening the cap 2 is also the same as in such prior-art devices. The container 1 is rotated around its longitudinal axis in the exemplary embodiment, while the cap 2 is mounted displaceably along the longitudinal axis of the screwing, guided linearly, so that the two screw threads are pulled over each other after a first engagement has been established and are tightened at the end of the screwing, so that the positive-locking and non-positive connection of the container 1 and the cap 2 is established.

The bottom part of FIG. 2 shows a state in which the screwing on of the cap 2 has been nearly completed. The suction connection between the cap 2 and the suction-type holding means 5 is still present in this state. This suction connection is abruptly eliminated by admitting pressure to the suction-type holding means 5 when the desired tightening torque is reached.

Until the desired tightening torque is reached, the suction tube 6 and consequently the cap 2 are prevented by a friction coupling 9 pressing the suction tube 6 with a defined frictional force from rotating together with the rotating container 1. The friction coupling 9 represents a means protecting against rotation for the suction tube 6 in relation to the displacing platform 12 until the frictional force acting on the suction tube 6 is reached. The friction coupling 9 is secured against rotation together with the platform 12 by means of the connection piece 7 and is connected to the suction tube 6 in a frictionally engaged manner. If the tightening torque 2 exceeds the frictional force applied by the friction coupling 9 on the suction tube 6, the cap 2 and, with the cap 2, also the suction tube 6, are carried by the container 1, which continues to rotate. Corresponding to its mode of action, the friction coupling 6 can also be called a friction brake. It is designed as a drum brake in the exemplary embodiment.

The final rotation position of the screwed-on cap 2 is predetermined by the end of the thread of the container 1 or by the cap 2 coming into contact with a shoulder of the container While specific embodiments of the invention have been shown and described in detail to illustrate the application of the principles of the invention, it will be understood that the invention may be embodied otherwise without departing from such principles.

What is claimed is:

1. The process for fastening a cap to a container, which cap and container are provided with engaging structure cooperating for the purpose of fastening, the process comprising the steps of:

positioning the container and the cap in a starting position in relation to one another by holding a cap with a clamping grip during the positioning;

connecting a non-clamping holding device to the cap;

releasing the clamping grip of the cap after positioning;

subsequent to said step of releasing the clamping grip, connecting the cap to the container whereby the cap is held as the container is moved, or the cap is moved relative to the container by the connection of the non-clamping holding device to the cap, up to a desired tightening torque.

2. The process in accordance with the claim 1, wherein the container and the cap are screwed together.

3. A device for fastening a cap on a container, which container and cap are provided with engaging means cooperating for the purpose of fastening, the device comprising:

a positioning means for positioning the container;

a holding and positioning means with a clamping holding means, which clampingly holds the cap and positions same in a starting position in relation to said container, said clamping holding means engaging the cap to connect the cap to the container in a positive-locking manner and said holding and positioning means also including a non-clamping holding means movable in relation to said clamping holding means, said non-clamping holding means connecting said cap to said container by a forced relative movement, said non-clamping holding means including a contact piece in contact with said cap and a friction coupling that is engagable and disengagable with said contact piece to hold said contact piece up to a defined frictional force between said contact piece and said friction coupling.

4. The device in accordance with claim 1, wherein said clamping holding means releases its clamping grip of the cap when said non-clamping holding means is fastened to the cap, and said non-clamping holding means holds the cap during a relative movement of the cap and the container to establish the connection with the container.

5. The device in accordance with claim 1, further comprising a bearing connection between said contact piece and said friction coupling said bearing connection permitting only free relative movement between said contact piece and said connection piece that is in a direction opposite a relative movement of the container and of the engaging cap.

6. The device in accordance with claim 5, wherein said bearing is a pivot bearing.

7. The device in accordance with claim 1, wherein said contact piece and said connection piece are connected to one another by a bearing for relative rotational movement between said contact piece and said connection piece.

8. The device in accordance with claim 7, wherein said bearing is a pivot bearing.

9. The device in accordance with claim 1, wherein said non-clamping holding means includes a suction source associated with said contact piece.

10. The device in accordance with claim 9, wherein said suction source is brought into contact with the cap positioned by said clamping holding means by means of said contact piece designed as a suction tube and is fastened thereto by suction.

11. A device for fastening a cap with a thread fastening portion on to a container with a corresponding cooperating thread fastening portion to be engaged with the cap fastening portion, the device comprising:

a container holding positioner for positioning of the container or for rotating the container in a position relative to the held cap;

a cap holding and positioning device for positioning the cap or for rotating the cap in a position relative to the held container including:

a clamping device for clamping contact with the side-wall of the cap for initially positioning the cap;

a contact device with a contact element contacting a top surface of the cap for holding the cap during relative rotation of the cap and container for fastening together the cap thread fastening portion to the container thread fastening portion and with a support connection part for rotating or holding the contact element, said contact device being holdable of the cap after said clamping device releases the cap in order for the contact device to rotate the cap onto the container.

12. The device in accordance with claim 11, further comprising a friction connection between said contact element and said support connection part for allowing the contact element to move relative to the support connection part above a desired tightening torque.

13. The device in accordance with claim 11, further comprising a bearing between said contact element and said support connection part for allowing the contact element to move freely relative to the support connection part in one direction.

14. The device in accordance with claim 13, wherein said bearing is a pivot bearing.

15. The device in accordance with claim 11, wherein said clamping device releases a clamping grip on the cap when upon relative movement of the cap and the container whereby only the contact element is in contact with the cap to hold or rotate the cap to fully engage the fastening portion of the cap with the fastening portion of the container.

16. The device in accordance with claim 11, wherein said contact element and said support connection part are connected to one another by a bearing for relative rotational movement between said contact element and said connection part.

17. The device in accordance with claim 16, wherein said bearing is a pivot bearing.

18. The device in accordance with claim 11, wherein said contact device includes a suction source in contact with the cap via said contact piece, said contact piece having at least one opening surrounded by a suction surface engaging the upper surface of the cap.

19. A device in accordance with claim 11, wherein:

said contact device is movable away from said clamping device while said contact device is holding the cap and the cap is released by said clamping device.

* * * * *